United States Patent [19]

Lesage

[11] Patent Number: 4,756,361

[45] Date of Patent: Jul. 12, 1988

[54] RADIATOR CORE

[76] Inventor: Philip G. Lesage, 1480 Riverdale Road, Thunder Bay, Ontario, Canada

[21] Appl. No.: 832,594

[22] Filed: Feb. 25, 1986

[30] Foreign Application Priority Data

Apr. 15, 1985 [CA] Canada ..... 479177

[51] Int. Cl.[4] ..... F28D 1/00

[52] U.S. Cl. ..... 165/149; 165/173

[58] Field of Search ..... 165/151, 174, 149, 76, 165/173

[56] References Cited

U.S. PATENT DOCUMENTS

| | | | |
|---|---|---|---|
| 3,899,553 | 8/1975 | Furlong et al. | 165/173 X |
| 4,044,443 | 8/1977 | Chartet | 165/173 X |
| 4,120,352 | 10/1978 | Husson | 165/173 |
| 4,289,507 | 9/1981 | Cadars et al. | 165/148 X |
| 4,502,532 | 3/1985 | Tomozaki et al. | 165/151 X |
| 4,564,066 | 1/1986 | Gorman | 165/174 X |
| 4,577,681 | 3/1986 | Hughes | 165/174 X |
| 4,582,127 | 4/1986 | Moranne | 165/173 X |

FOREIGN PATENT DOCUMENTS

| | | | |
|---|---|---|---|
| 158778 | 12/1952 | Australia | 165/173 |
| 837972 | 3/1970 | Canada | 257/27 |
| 868783 | 4/1971 | Canada | 257/24 |
| 872111 | 6/1971 | Canada | 257/22 |
| 975353 | 9/1975 | Canada | 257/24 |
| 991168 | 6/1976 | Canada | 257/27 |
| 1090780 | 12/1980 | Canada | 257/23 |
| 1114590 | 12/1981 | Canada | 26/146 |
| 2435632 | 7/1974 | Fed. Rep. of Germany | 165/149 |
| 148394 | 9/1983 | Japan | 165/173 |
| 29777 | of 1912 | United Kingdom | 165/76 |

*Primary Examiner*—Ira S. Lazarus
*Assistant Examiner*—Peggy Neils

[57] ABSTRACT

A radiator core has header plates provided with resilient grommets grooved to receive the edges of the header plates. Circular tubes extend between the header plates and pass through central bores in the grommets which press inwardly thereon. Fins extend transversely to the tubes which extend through collars in the fins.

6 Claims, 5 Drawing Sheets

Figure 1:
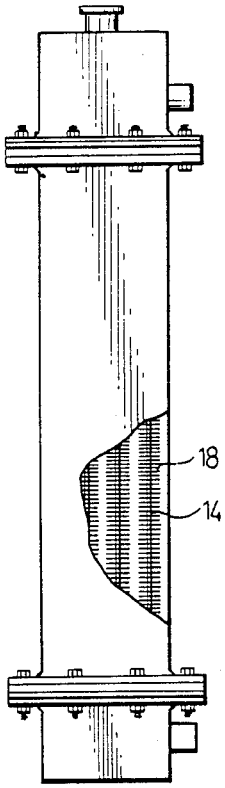

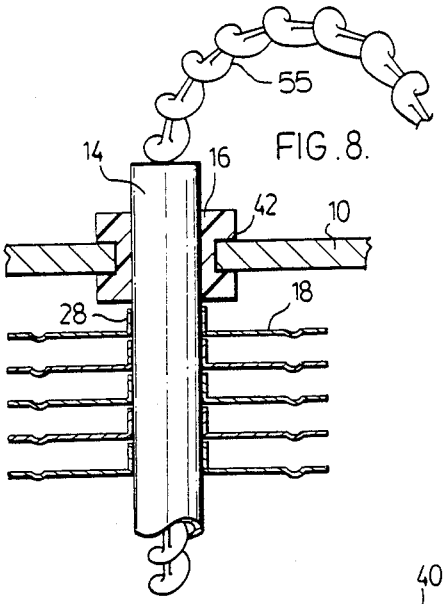
FIG. 8.
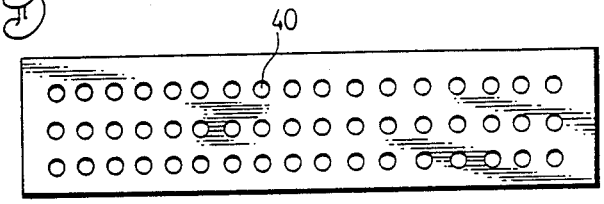
FIG. 9.
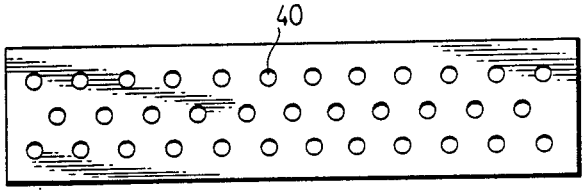
FIG. 10.
FIG. 11.
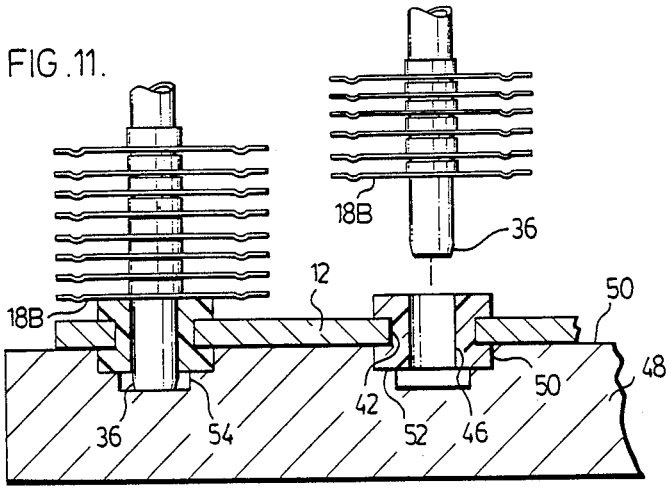

RADIATOR CORE

This invention relates to the construction of radiator cores designed principally for installation at the front of a truck or other vehicle for cooling the coolant fluid of the engine.

Such radiator cores comprise a plurality of metal tubes extending between upper and lower header plates. The upper and lower header plates form the bottom and top respectively of an upper or inlet tank and a lower or outlet tank. The water or other coolant fluid for the vehicle engine travels downwardly through the tubes, being cooled in such travel by the travel of air over the surfaces of the tubes and any fins in thermal conducting relation with the tubes. Fins were located in thermal conducting relationship with the tubes in order to enlarge the heat radiating area of the assembly and assist in the cooling of the fluid in the tubes. In some prior constructions the fins were individual to particular tubes and in others, each fin was common to a number of tubes.

In prior constructions the vertically extending metal tubes were oval shaped in cross-section, displaying a small width in the forward and rearward direction of the vehicle and relatively greater width transverse to such direction. Such tubes had a relatively large radiating area for their volume and width and allow good air flow therebetween. However the spacing between the tubes tended to be wide enough, and the air flow free enough that a substantial proportion of the air passed through unheated. The tubes were however expensive to construct, assemble and repair.

It is an object of this invention to provide a vehicle radiator core assembly wherein the vertically extending metal tubes are substantially circular in cross-section. Such tubes are relatively economical to construct and replace. The area of such circular tubes is not as large relative to the volume as in an oval tube but provides a relatively wide area e.g. the front half cylinder of the tube on which the cooling air impinges in the travel of the vehicle. The circular tubes are therefore arranged to present a relatively large area to the coolant air. Moreover the spaces between tubes, transverse to the motion direction, may be made relatively small. Where a number of the vertical tubes are arranged in transverse rows the tubes of a rearward row may be staggered relative to the tubes of a forward row to receive the air passing between the tubes of a forward row. The use of the circular tubes, with or without the staggered arrangement just referred to, has been found to provide efficient cooling and a strong construction with the tubes, and the assembly resulting therefrom simple to manufacture, to repair and to replace.

Prior radiator cores where the cooling tubes were provided with individual fins have been found difficult and expensive to construct and replace. Prior radiator cores where the fins were in thermal conducting relationship to a number of tubes required expensive and complex fabrication techniques to obtain the required disposition of the fins and their attachment in thermal conducting relationship to the tubes, usually by expensive soldering techniques.

It is an object of this invention to provide a novel core assembly which is cheap and simple to construct and may be provided, if desired, without soldering, and which provides modules comprising a plurality of fins, each apertured to receive a plurality of tubes with the fins transversely extending across the width of the module the fins being vertically disposed relative to each other along the tubes of the module. The tubes are provided with upstanding collars surrounding each aperture and the collars are in pressure relationship to the tubes which pass therethrough. Soldering may be avoided. The fins, pressure fitted to the tubes, through the collars, hold their position so that no special spacer means are required. The assembly of tubes and fins connected in this way, may also flex a small amount, the tubes slightly out of the vertical with consequent displacement of the fins, to conform to stresses on the vehicle and radiator assembly during travel. Because of the construction it is unlikely that any damage will ensue from such flexure.

There is a preferred method of construction of the assembly described in the previous paragraph. In accord with the method, the fin collars are dimensioned to slidably receive the tubes in a sliding fit. The fins are therefore held in the parallel arrangement and spacing desired in the final assembly by temporary racks. The holes on the fins are aligned in the array. The tubes are then loosely slid into the aligned collars to their desired disposition relative thereto. The tubes are then temporily clamped in their desired disposition while they are expanded outwardly by a tool to achieve a press fit with the fins. Such press fit supplies the necessary thermal conductivity between fins and tubes and also supplies a permanent connection so that after enlargement of the tubes into the press fit the temporary fin rack assembly and the tube clamps may be removed leaving a module of tubes and fins in the desired permanent arrangement.

Prior core assemblies have required complex arrangement and soldering to attach the tubes to the header plates through which they project.

It is an object of another aspect of this invention to provide header plates in which the aperture may be simply stamped and no special forming need take place in relation thereto. Resilient grommets are formed with a central radially outwardly facing groove to receive the aperture defining edge of the header and to be slightly inwardly biased to reduce the diameter of the central, tube-receiving bore through the grommets. The central grommet bore is preferably made slightly smaller than the outer diameter of the tube when the grommet is unstressed, and of course the negative clearance for the tube is increased due to the inward pressure of the header plate edge. The grommet may be simply applied to the header plate without any treatment to the header plate other than punching the aperture. The tube is inserted in the grommet and the pressure on the grommet between the tube and the header plate edge seals the junction between grommet and plate and the junction between grommet and tube.

Figure 2:
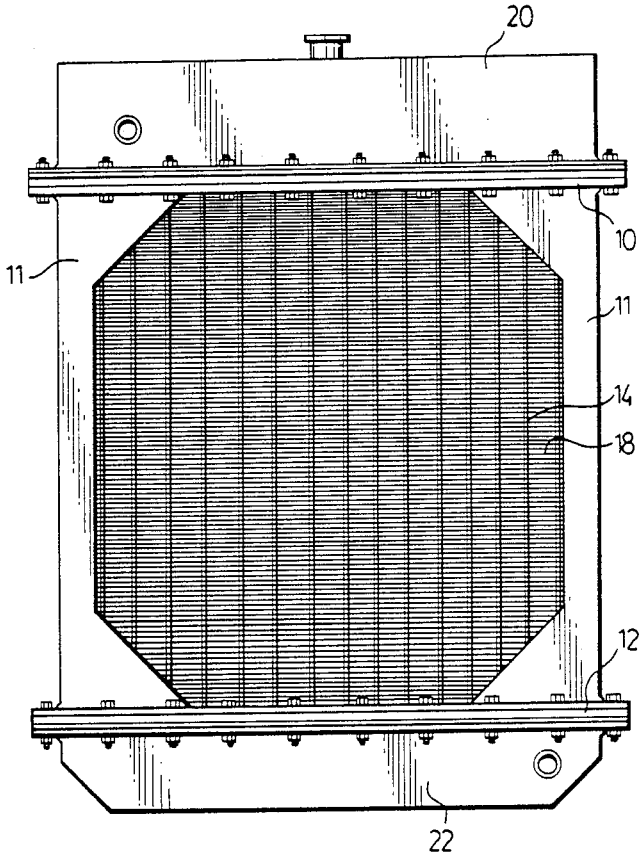
Figure 3:
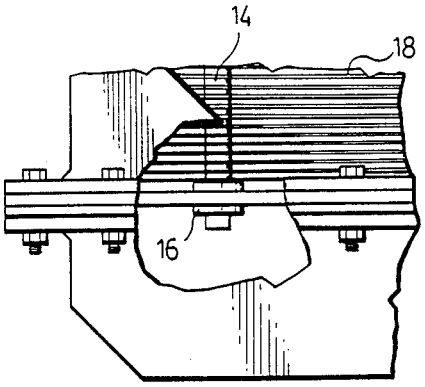
Figure 4:
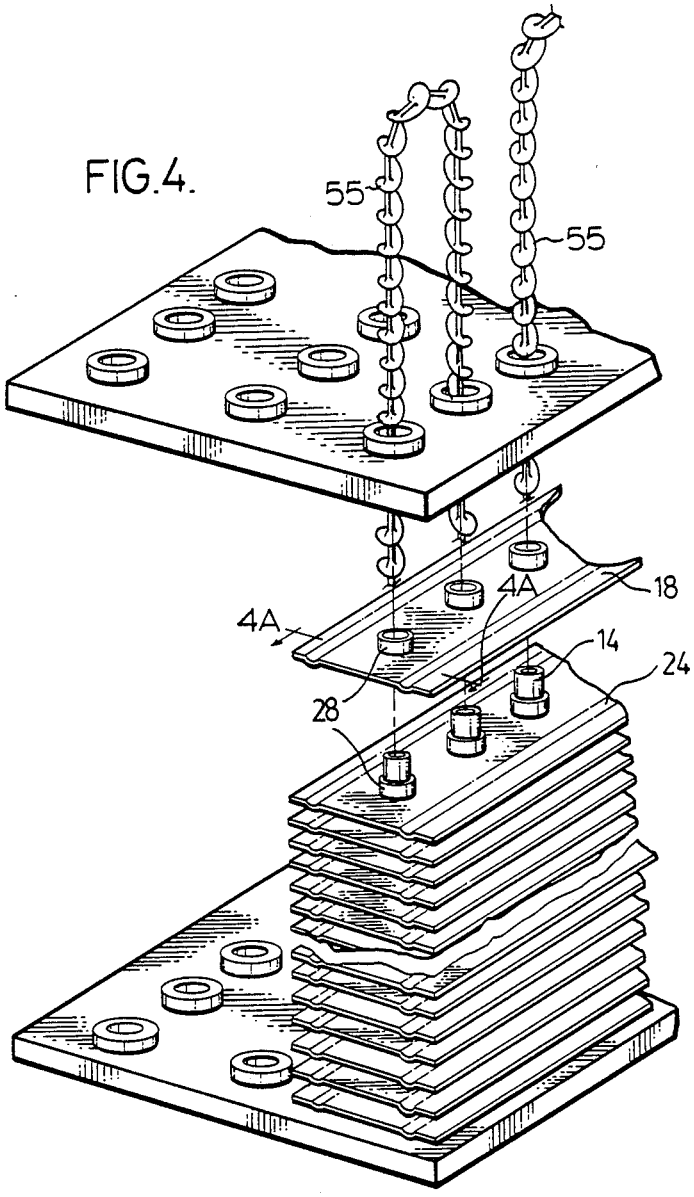
Figure 4A:
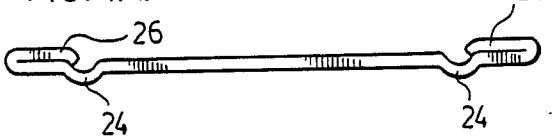
Figure 5:
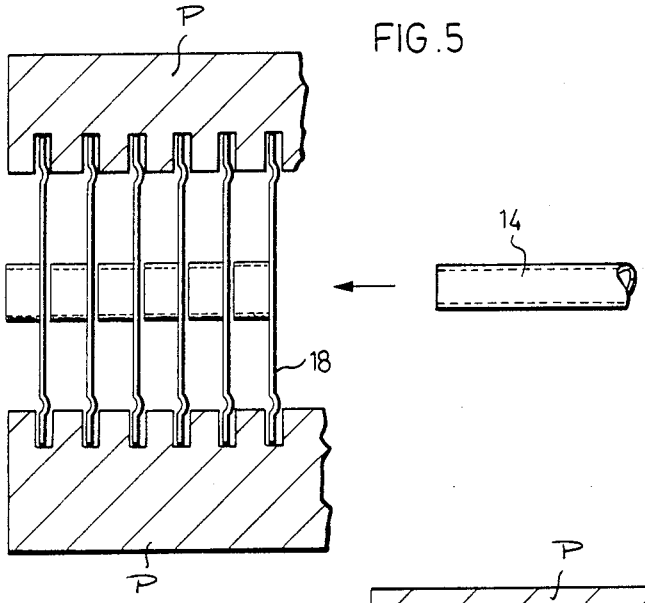
Figure 6:
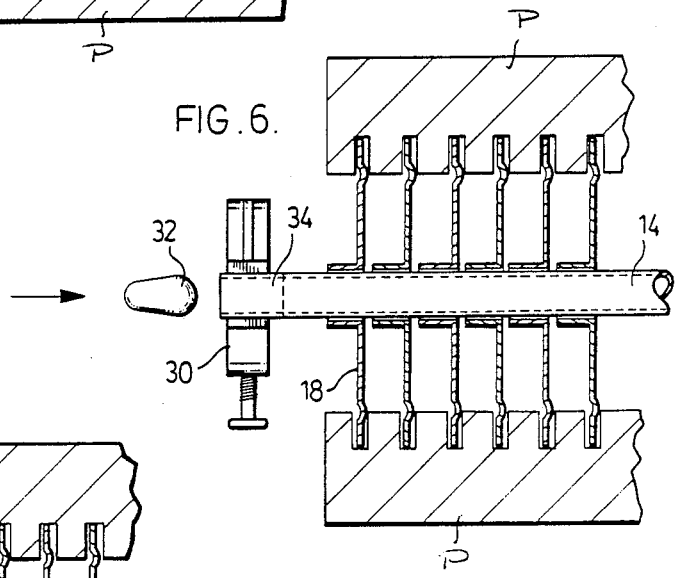
Figure 7:
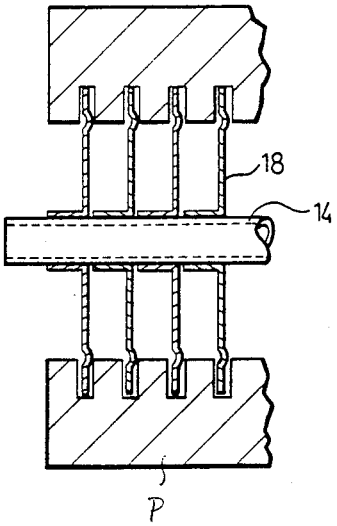
Figure 12:
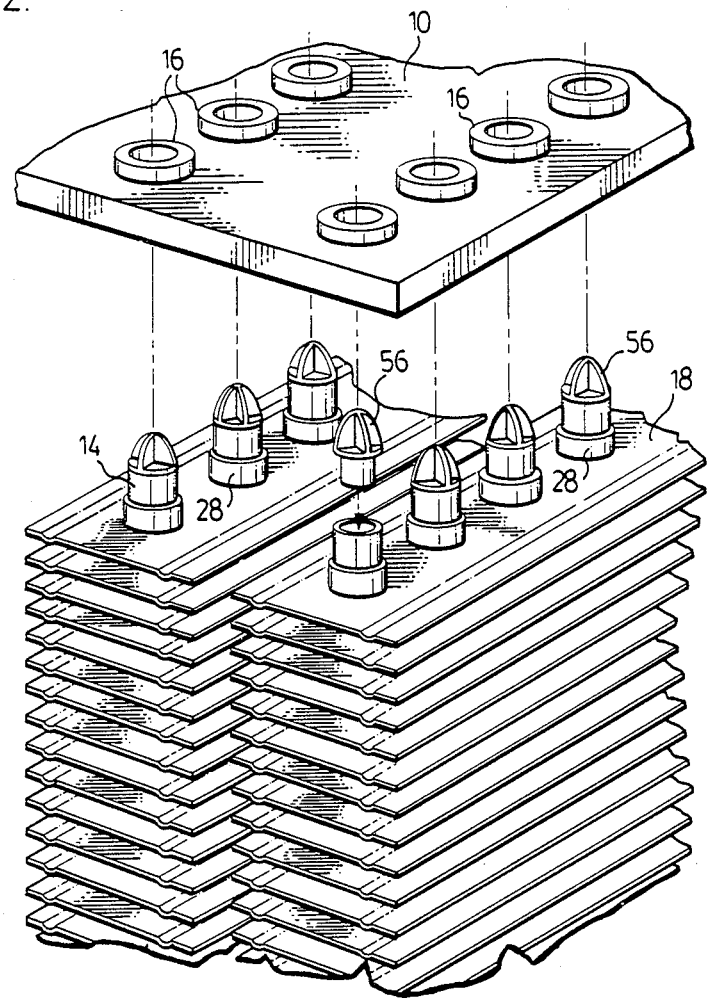

In drawings which illustrate a preferred embodiment of the invention:

FIG. 1 shows a side view of a radiator core in accord with the invention with upper and lower tanks attached to the core headers, FIG. 2 shows a front view of the elements of FIG. 1, FIG. 3 is a view of a part of FIG. 2 broken away to show the tube and grommet connection to the lower header plate, FIG. 4 is an exploded view of the radiator core elements, FIG. 4A is an enlarged fin cross-section, FIGS. 5, 6 and 7 are side views demonstrating the means of assembling the tubes to the radiator cores, FIG. 8 shows a tube and fins with the tube installed in a header plate grommet, FIGS. 9 and 10 show alternate arrays of tube apertures in a header plate, FIG. 11 shows the installation of tubes in a lower header plate, and FIG. 12 shows the installation of the tubes in the upper header plate.

In the drawings, FIGS. 1–3 show the radiator core comprising: upper header plate 10, lower header plate 12 tubes 14 extending between the header plates and in sealing relationship to grommets 16 which are in sealing relationship to the header plates as hereinafter described. Frame members 11 extend between the upper and lower tanks in the finished assembly and enclose the ends of the core as shown. Fins 18 are shown, extending transversely across the core and as FIG. 1 indicates there may be several modules (here three) of fins and tubes extending transvesely across the core with the module disposed from front to back across the core. FIGS. 1–3 show the upper and lower tanks 20 and 22 which are conventional and attached to the upper and lower header plates. When the core in accord with the invention is in use, water or coolant fluid is provided to the upper tank 20 from which it is drawn by gravity through tubes 14 to the lower tank. In its travel through tubes 14 the liquid is cooled by radiation from the outside of the tubes and from the fins 18 which are in heat conducting relationship with the tubes in the same transverse row of the array. Radiation of the heat from the tubes and fins is to the air travelling over the vehicle carrying the radiator during the vehicle's travel.

As indicated by FIGS. 1 and 4 there are preferably in the core a number of (here three) transverse rows of fins and tubes. Each fin is preferably apertured for and corresponds to a single transverse row of tubes, although this is not necessarily the case. Each fin is (as illustrated in FIG. 4A) generally a flat thin metal sheet preferably of copper or steel extending the width of the core. The fin is preferably shaped to form a pair of convex downward ribs 24 and has material 26 adjacent its forward and rearward edges folded inward in a hairpin turn parallel to the main extent, both features being designed to provide strength and stability to the fin. For simplicity of illustration, the hairpin bent material is shown only in FIG. 4A although it is the preferred arrangement for all fins.

At spaced locations along the fin, apertures are provided for the tubes. Such apertures are defined by collars 28 extending integrally upwardly (downwardly is a viable alternate although less feasible) from the fin. Such collars are made by stamping and extruding the fin material to form the desired collar height and to define the desired bore diameter by techniques well known to those skilled in the art.

The tubes, preferably made of copper, are initially made of a length to extend between the upper and lower header plates 20 and 22 and to project past the grommets 16 therein as best indicated in FIGS. 3 and 11. Initially the tubes are made about ½ inch longer than finally required for a purpose to be specified hereafter. Initially the tubes are made with an outside diameter to make a close sliding fit with the inside of the collars.

It is desired to discuss the assembly of the fins and tubes before describing the remainer of the core assembly.

As indicated in FIGS. 5–7 the fins 18 are supported at their sides in pitch plates P which, as shown, are slotted to provide the desired fin spacing and arranged so that the fins will be in parallel arrangement both along their length and from side to side. The relation between the fin spacing and the collar 28 height is such that there is a very short distance, about 10% of the collar height between the free end of one collar and the next fin. With the fins in their desired locations, the tubes 14 are slid into place through the aligned collars as schematically indicated in FIG. 6. As previously indicated the tubes are each provided with about ½" of extra length indicated at 34. This ½ inch extent 34 is used to clamp the tubes in any desired manner, as indicated at 30 in FIG. 6. With the tubes 14 clamped, an expanding tool 32, well known to those skilled in the art is pushed through the tubes 14 and acts to expand them into a press fit with the collars 28. Such expansion techniques and tools are well known to those skilled in the metal-forming art. We prefer to use machines with such a tool, designated Flexpander or Porta-Expander and manufactured by Pridan Tool and Machine Inc, P.O. Box 608, Danville, Illinois 61832, U.S.A. The tool does not quite reach the end of the tube in the travel direction, leaving a short, un-enlarged portion (see 36 in FIG. 11) which will assist in the insertion of one end of the tubes in the grommets. With the tubes 14 expanded into a pressed fit with the fins collars 28 through which they pass, the clamping means are removed and the extra extent 34 of the tubes is cut off. The tubes, now press fitted to the fin collars are now fixed relation thereto and a secure fin and tube module has been formed, fixed except for a very slight flexure allowed of the tubes out of their attitude perpendicular to the fins in the vibration of the vehicle and frame 11.

The header plates 10 and 12 are preferably made of brass, and punched to produce the apertures 40 in the desired array pattern, for example that of FIG. 9 or that of FIG. 10. The header plates, in contrast to those of the prior art are made thick enough to withstand the stresses of tube insertion and use of the core without the necessity of shaping to provide supporting channels, flanges, etc. Further the thickness of the header plate is chosen so that such channels, flanges etc. are not required to widen the loading contact area with the grommets to avoid crushing them during compression. It is found that a thickness of 0.125" in the header plate will avoid crushing the grommets. Thus the inventive design allows the header plates merely to have apertures stamped therein to prepare them for use, and other preparation is not required. The grommets 16 are of resilient material selected to maintain the resiliency and strength of the grommets in the necessary condition of heat and cold which will be encountered by the radiator in use. It is preferred to use silicone and of the silicone materials available we prefer to use "60 Duro Grey" manufactured by Silcofab a Division of Robco Inc. 333 Woodlawn Road, West, Guelph, Ontario, Canada N1H 676. The choice of grommet qualities is constrained to materials yieldable enough to allow tube insertion and resilient enough to seal against the tube walls and header plate edges. Silicone is very much preferred to rubber which is much more subject to deterioration and cracking under the range of temperature conditions. The grommets 16 are preferably made cylindrical in shape but in any event have a central bore and define a radially outward facing groove 42 whose circular or cylindrical root 44 is, when the grommet is unstressed, just slightly larger than the header plate apertures 40. The bore 46 in the grommet is made, in the relaxed state of the grommet, slightly smaller than the outside diameter of the tube (after expansion by tool 32). The resilient compressible grommets 16 are inserted in the header plates by the necessary manipulation. The diameter of the header holes 40 is such as to slightly compress the grommets bearing inward on the groove roots to further decrease the diameter of the inner grommet bore 46. With the grommets 16 in place, one of the header plates, here the lower, is laid on a supporting die 48 shaped as indicated in FIG. 11. The supporting die 48 has a level upper surface 50' to support the bottom header plate 12. A recess 50 is provided shaped to receive the portion of the grommet 16 located below the header plate 12 and to support it about the periphery on upwardly facing surfaces 52. The upwardly facing surface 52 is centrally recessed in turn to provide a downward wall 54 of the depth desired for the tubes. The well 54 is large enough to receive the end of a tube 14 but small enough to be surrounded by the surface 52 in a location to bear upwardly on the lower surface of the grommet. A module comprising a single transverse row of tubes with the fins attached is then slid into the corresponding row of grommets until the tubes 14 reach the bottom of well 54. A lubricant may be used on the outside of the tubes if desired. It will be noted that, as is preferred, the bottom fin 18B of each module rests on the upper surfaces of the grommets. It will also be noted that the press fits between the tubes and the fins serve to hold the fins in place when the tubes are being located in the grommets 16. It is noted that the grommets were originally designed to make negative clearance with the tubes and are further pushed inward by the header plate edges, to press firmly against the outer surface of the tubes 14 pushed therethrough which tubes in turn press outwardly on the grommets. Thus a good seal is formed between the grommet and the header plate on the one hand and between the grommet and the tubes on the other. Although sealant may be used at either of these joints, within the scope of the invention, such sealant is normally not required.

With all tubes in all modules attached to the lower header plate 12, the upper header plate 10 may be applied. With the tubes of all modules standing vertically from the lower header plate 12, guides are preferably provided for the upper tube ends. See FIG. 12. The guides 56 have tapering upper ends, preferably with splines as shown and have on their lower sides a cylindrical extent to be slidably received in the upper ends of the tubes 14 and a downwardly facing shoulder to seat on the tip of the tubes 14. The maximum outer diameter of the guides should not be greater than the outside diameter of the tubes. Before insertion, the tubes 14 and guides 56 may have lubricant applied. The upper header may then be applied to the guides and tubes manually with a support die 48, of the type shown in FIG. 11 but recessed to receive guides 56 inverted over the upper header plate to press it into place on the tubes to the required depth which is determined when the upper ends of the tubes reach the surface of the inner well 54 of the die. As with the lower header plate, a sealant will not usually be required between the grommet and the upper header plate or between the grommet and the tube outer wall. When the die is withdrawn and the pointed guides 56 removed, the core is ready for use. It will be combined with the upper and lower tanks and surrounding frame by techniques well known to those skilled in the art, to produce a vehicle radiator one example of which is shown in FIGS. 1, 2 and 3.

It is found that the performance of the device in accord with the invention can be considerably increased if the water or coolant fluid is caused to follow a tortuous or helical flow through the tubes 14. The path should not be made so tortuous that the rate of flow through the device is seriously impeded. A suitable device for causing helical flow is the shape, resembling a wood bit of the tube insert 55 shown in FIGS. 4 and 8. Such insert may be made of plastic. The insert 55 may be made long enough to be inserted as an inverted U into the upper ends of two tubes as shown in these Figures. The invented U shape keeps the spiral inserts from slipping down the tubes into the lower tank 22 and avoids the necessity of providing a special arrangement for this.

Among the advantages of the invention in its various aspects will be noted.

The header plate - grommet-tube using simple and economic manufacturing and assembly techniques.

The collar-tube press fit connection provides good thermal conductivity between fin and tube, sufficient adhesion that the tubes and fins retain their desired spatial relationship in handling, installation and use.

The collar-tube connection allows the slight flexure required for the fins and tubes to flex slightly out of their mutually perpendicular attitude during stresses and vibrator of the core in handling or of the vehicle in motion.

When the invention is employed using modules, each having a single transverse row of vertical tubes, as shown in the preferred embodiment, each module is individually replaceable in case of damage. With many prior art radiator cores damage to an element required replacement of the entire core.

The use of modules each having transverse rows of vertical tubes allows different choices to be made of the materials for each module. For example the fins of the front module of a vehicle may be made of steel for better wear and strength while the fins of other modules may be made of copper for better cooling effect.

Although solder may be used within the scope of the invention, the invention in many applications will require no solder rendering it simpler to manufacture and repair and replace.

I claim:

1. Radiator core comprising:

upper and lower generally flat, separate header plates of at least substantially 0.125" extending transversely of said core, aligned stamped apertures in said upper and lower header plates forming edges on said header plates facing said apertures which are substantially perpendicular to said transverse direction, individual of resilient material in said apertures, said grommets having a central bore, side walls of said grommets defining a groove radially outwardly facing from said bore, said groove having a bottom designed to be biassed inwardly by the header plate material defining said aperture, substantially circular metal tubes received in said grommets extending between aligned apertures, said tubes projecting through said grommet bores, said grommets being dimensioned to press inwardly on said tubes, fins located on a plurality of tubes and extending transversely, said fins defining apertures for said tubes, said fin being integrally provided with collars surrounding said apertures, said tubes extending through said collars in full thermal conducting contact therewith.

2. Radiator core as claimed in claim 1 wherein said grommets are dimensioned when unbiassed to make a negative clearance with said tubes.

3. Radiator core comprising:

upper and lower header generally flat, separate plates of at least substantially 0.125" extending transversely of said core, aligned apertures in said upper and lower header plates forming edges of said header plates facing said apertures which are substantially perpendicular to said transverse direction, individual grommets of resilient material in said apertures, said grommets having a central bore, side walls of said grommets defining a groove radially outwardly facing from said bore, said groove having a bottom designed to be biassed inwardly by the header plate material defining said aperture, substantially circular metal tubes received in said grommets extending between aligned apertures, said tubes projecting through said grommet bores, said grommets being dimensioned to press inwardly on said tubes, fins located on a plurality of tubes and extending transversely, said fins defining apertures for said tubes, said fin being integrally provided with collars surrounding said apertures, said tubes extending through said collars in full thermal conducting contact therewith.

4. Radiator core as claimed in claim 3 wherein said grommets are dimensioned when unbiassed to make a negative clearance with said tubes.

5. Radiator core as claimed in claim 1 wherein said grommets are constructed of silicone.

6. Radiator core as claimed in claim 3 wherein said grommets are constructed of silicone.

* * * * *